US006860567B1

(12) United States Patent
Bauer

(10) Patent No.: US 6,860,567 B1
(45) Date of Patent: Mar. 1, 2005

(54) POOLSIDE LOUNGE CHAIR

(76) Inventor: Bo Bauer, 135 Stonemill Rd., Dayton, OH (US) 45409

( * ) Notice: Subject to any disclaimer, the term of this patent is extended or adjusted under 35 U.S.C. 154(b) by 0 days.

(21) Appl. No.: 10/799,956

(22) Filed: Mar. 12, 2004

Related U.S. Application Data

(60) Provisional application No. 60/454,913, filed on Mar. 14, 2003.

(51) Int. Cl.[7] ..... A47C 1/14; A47C 27/00; A47B 83/02

(52) U.S. Cl. ..... 297/900; 297/144; 297/228.12; 297/354.13; 297/357; 297/377

(58) Field of Search ..... 297/900, 354.12, 297/354.13, 357, 377, 144, 228.11, 228.12

(56) References Cited

U.S. PATENT DOCUMENTS

| | | | | | |
|---|---|---|---|---|---|
| 336,387 | A | | 2/1886 | Child | |
| 880,206 | A | | 2/1908 | Eyles | |
| 988,600 | A | | 4/1911 | Simpson | |
| 3,484,878 | A | | 12/1969 | Nielsen | |
| 3,747,916 | A | | 7/1973 | Benson | |
| 3,897,102 | A | * | 7/1975 | Lemaire | 297/900 X |
| 3,954,195 | A | | 5/1976 | Deuchar | |
| 4,083,068 | A | * | 4/1978 | Bohme | 297/377 X |
| 4,207,635 | A | | 6/1980 | Leroy | |
| 4,264,102 | A | * | 4/1981 | Sroub | 297/377 |
| D278,392 | S | | 4/1985 | Bayly | |
| 4,606,086 | A | * | 8/1986 | Rowland | 297/900 X |
| 4,616,370 | A | | 10/1986 | Keenan et al. | |
| 4,684,170 | A | | 8/1987 | Colby | |
| 4,891,854 | A | * | 1/1990 | Finkelstein | 297/900 X |
| 4,941,222 | A | * | 7/1990 | Prager | 297/900 X |
| 5,121,969 | A | * | 6/1992 | Schroeder | 297/900 X |
| 5,222,779 | A | * | 6/1993 | Johnson | 297/900 X |
| 5,237,713 | A | * | 8/1993 | Prager | 297/900 X |
| 5,251,956 | A | * | 10/1993 | Hofmeyer | 297/144 X |
| 5,275,463 | A | * | 1/1994 | Rocha | 297/228.12 X |
| 5,297,850 | A | * | 3/1994 | Guleserian | 297/377 |
| D352,635 | S | * | 11/1994 | Yoder | 297/900 X |
| 5,466,039 | A | * | 11/1995 | Umbrianna | 297/900 X |
| 5,524,957 | A | * | 6/1996 | Gibriano | 297/144 |
| 5,624,157 | A | * | 4/1997 | Kostuk | 297/900 X |
| 5,829,080 | A | * | 11/1998 | Robillard et al. | 297/900 X |
| 5,926,871 | A | * | 7/1999 | Howard | 297/900 X |
| 5,946,749 | A | * | 9/1999 | Sewell | 297/900 X |
| 5,950,259 | A | * | 9/1999 | Boggs | 297/900 X |
| 6,042,184 | A | * | 3/2000 | Kofoed | 297/900 X |
| 6,059,365 | A | * | 5/2000 | Diamond | 297/900 X |
| 6,068,342 | A | | 5/2000 | Mariani et al. | |
| 6,109,685 | A | * | 8/2000 | Lindsey et al. | 297/900 X |
| D450,942 | S | | 11/2001 | Jones | |
| 2002/0079731 | A1 | * | 6/2002 | Sisti | 297/397 |
| 2004/0108757 | A1 | * | 6/2004 | Jackson et al. | 297/900 X |

* cited by examiner

*Primary Examiner*—Rodney B. White
(74) *Attorney, Agent, or Firm*—Dinsmore & Shohl LLP

(57) ABSTRACT

A lounge chair with ergonomic features. The lounge chair includes frame, a contoured seat section and an adjustable contoured back section that can be angularly biased relative to the seat section. The mechanism that permits the angular positioning between the seat and back sections includes a biasing member (such as a spring) and an actuator that can be operated with one hand, thereby promoting ease of use. A variable-position aperture formed into the back section can accommodate users of different heights. The contouring can be bowed upward to provide additional ventral or dorsal support to a user depending on whether the user lying prone or supine on the chair. In one embodiment, the lounge chair is of predominantly wooden construction, preferably from a dense hardwood.

26 Claims, 5 Drawing Sheets

POOLSIDE LOUNGE CHAIR

This application claims the benefit of the filing date of U.S. Provisional Application No. 60/454,913, filed Mar. 14, 2003.

BACKGROUND OF THE INVENTION

The present invention relates generally to a lounge chair where the chair supports the full body length of the user to support the user in the seated or prone position, and more particularly to a chair which provide orthopedic support for the spine while lying prone.

Lounge chairs used to support a person while lying prone or seated and which have a back section that is hinged to allow angle adjustment are known. In one configuration, these chairs, which are often used as recreational furniture around homes, pools, beaches or the like, generally include a lightweight hinged frame that is horizontal to the ground supported by legs, where fabric or vinyl strips span the frame. At least one of the hinged sections is generally about one third of the way from the head so that the head section can be angled relative to the seat section. This adjustment allows the user to adjust the seatback from a relatively flat position to a nearly perpendicular seated position. The hinged section typically allows the chair to be folded flat and compact for portability and storage. Actuation and attainment of a preset angle between the seat section and the back section is typically effected by the engagement of a toothed rack with a substantially linear bar or pin. With such mechanism, the user must get out of the chair (or at least sit forward enough to avoid biasing the back section toward a horizontal position) and, while holding the back section in one hand, attempt to secure the rack into the bar or pin at the desired position. Only upon reclining does the user discover whether the back section is at the proper angle, and if not, the user must repeat the process again. Moreover, there is chance of injury, as the user can get fingers caught between the rack and bar or pin. Additional features, such as a fixed face opening to allow the user to lie prone while the head is supported by the opening, and lumbar support, are also known.

With an emphasis on lightweight, inexpensive features, the construction of lounge chairs and related furniture is such that it is not compatible with long-term use. In addition, the simplistic construction, which is often geared to low-cost devices, doesn't readily lend itself to user comfort over extended periods of use, as features commensurate with comfort-enhancement require additional support and functionality, neither of which are in keeping with conventional lounge chairs and related devices. When a user is lying prone on the chair with the head turned to one side (full lateral), the cervical upper thoracic portion of the spine necessarily must curve (torque) to accommodate the head position. This stresses the uncovertebral joints, which can initiate neck pain or aggravate arthritis. Similarly, lumbar and related support is not possible unless cumbersome pads to alter the surface contour are placed on either or both the seat and back sections. Furthermore, even with chairs that do possess user-comfort features, such as a face opening placed in the surface of the back section, the inability to accommodate users of different heights severely limits the chair's utility.

Moreover, discriminating buyers who are striving to maximize the aesthetic features of a pool, patio or related recreational area might think a vinyl-clad, aluminum frame chair inconsistent with these goals, especially after the chair has been exposed for prolonged periods to the sun, rain and other environmental conditions. For this segment of the market, other more robust lounge chair configurations have been created to overcome the shortcomings of the first variant. In this second variant, relatively sturdy wooden construction is in evidence, with emphasis on rigid, relatively stationary pieces that more resemble furniture than their vinyl-clad, aluminum-framed counterparts. As with the first configuration, accommodation of users of differing size and concomitant orthopedic needs are not addressed, where, for example, the relationship between the face opening and the remainder of the chair remain fixed. Similarly, where the angle adjustment mechanism of such upscale chairs requires two-handed operation, no operability improvements are realized over their low-cost counterparts.

Accordingly, there exists a need for a lounge chair that can accommodate users of different sizes such that the user can lay prone while minimizing discomfort. There also exists a need for a lounge chair that is easy to operate, retains portability and user convenience features, and maintains its aesthetically pleasing attributes over prolonged exposure to harsh environments.

SUMMARY OF THE INVENTION

The present invention satisfies these needs by providing an orthopedic lounge chair which is very rugged and durable in its construction, yet easy to operate. According to a first aspect of the present invention, a lounge chair includes a frame, seat section, back section and hinge section to pivotally couple the back and seat sections. The back and seat sections define upper surfaces for engaging a user, where the seat section defines an orthopedic upper surface. In the present context, a surface is considered orthopedic if it includes contouring or shaping that provides enhanced support to a body portion, such as ventral or dorsal regions in the torso. The hinge section includes an actuator responsive to user input, an angle adjustment mechanism responsive to the actuator, and a biasing member to promote the selective engagement of the angle adjustment member to at least one of the back and frame sections. The biasing member maintains the aforementioned engagement until overcome by deployment of said actuator, which forces disengagement of the cooperative components. During this disengaged period, a plurality of angular positions between the back and seat sections is possible.

Optionally, the orthopedic upper surface of the seat section chair has a fixed convex (upwardly bowed) arch to provide the enhanced support. For example, additional lumbar support is available to a user lying prone on the chair. In this configuration, the arch support gently pushes upward on the hips of the user, straightening out the natural curvature of the lumbar section of the spine. This position relaxes the lumbar and avoids the uncomfortable hyperextension experienced by conventional lounge chairs. In another option, the chair is constructed predominantly from rigid materials, such as wood, where the wood is preferably hardwood, such as ipe, teak or oak. It will be appreciated by those skilled in the art that other materials, such as high quality plastic resin, stainless steel, or the like could be used. In the present context, construction of a component that is "predominantly" from a particular material does not necessitate that the entirety of the component be made from that material, just that a majority of it be so. In such case, ancillary materials, such as metal or plastic for connectors, fasteners or particular portions of the component, can be used to facilitate proper functioning or assembly of the component. In addition, the rigid nature of the construction enables the orthopedic upper surface to be integrally formed into the seat section.

In another option, the head aperture formed into the back section is adjustable to allow different size users to maintain optimum orthopedic positioning. The head aperture eliminates the need of the user to rotate the neck while lying prone, thus eliminating the undue stress to the upper neck and back, and allows the upper cervical spine to maintain alignment, avoiding uncomfortable hyperextension or lateral rotational stress in the upper back and neck. Since the upper surface of the back section is rigid, the aperture (which can be formed by a plurality of discreet slats that are each slidably mounted to longitudinal support members in the back section) can be varied by moving one or more of the slats up or down the back section support members. In one form, the back section support members may define a plurality of rails that can be slotted to engage complementary surfaces in the slats making up the head aperture. In the present context, the longitudinal dimension of the chair is the one along the chair's generally elongate (i.e., head-to-foot) direction. Moreover, the numerous slats making up the aperture can be coupled together so that they move in unison.

In addition, at least the seat section can be tapered across the narrow (side-to-side) dimension to provide rigid support rather than the scoop or concavity experienced in the seat and back sections of conventional lounge chairs. Such a taper would allow the lateral (side) edges of the seat section to be lower than the central portion of the seat section. By being formed of the aforementioned rigid materials (such as wood or the like) and not relying on straps or fabric that stretch further downward under the applied weight of a user, the chair is easy to get into and out of.

In another option, the biasing member is a spring-loaded mechanism that allows the user to adjust the seatback to the desired angle without having to reach under the seat to set adjust the member (also referred to as the catch) on the frame or back section that engages the angle adjustment mechanism, which can be in the form of a generally semi-circular wheel with splines formed therein. These splines can be made to selectively engage a complementary catch that is rigidly affixed to the frame by operating the actuator. In one form, the actuator is a release handle placed in such a location as to be easily graspable by the user. For example, the actuator is disposed on the back section and is responsive to single-hand input such that the angular position between the seat and back sections can be adjusted while the user is on the lounge chair by having the user grasp the actuator and the back section simultaneously. This allows the user to then lower the back section with one hand while seated, not having to reach under the back section to adjust the angle adjustment mechanism that selectively engages the catch. The tight tolerance between the frame of the chair and the back section minimizes the risk of pinching the user's hand when the back section is fully reclined to substantially flat position. In the present context, the term "substantially" is utilized to represent the inherent degree of uncertainty that may be attributed to any quantitative comparison, value, measurement, or other representation. As such, it refers to an arrangement of elements or features that, while in theory would be expected to exhibit exact correspondence or behavior, may in practice embody something slightly less than exact. The term also represents the degree by which a quantitative representation may vary from a stated reference without resulting in a change in the basic function of the subject matter at issue. The spring-loaded nature of the biasing member assures the catch is fully engaged with the angle adjustment mechanism, thereby promoting safety by preventing a partially engaged angle adjustment member from slipping off the catch and causing collapse of the back section. By being spring-loaded, the user only needs to simply pull up on the seatback to the desired angle and the notched catch will automatically engage. To lower the back section, the user simply squeezes the handle which releases the angle adjustment member from the catch, thereby allowing the user to lower the back section to the desired position. This one-handed operation is possessive of an inherit safety element, where the user is simultaneously grasping the seatback and the release handle, causing the user to hold on to the seatback, not allowing it to inadvertently collapse down onto the frame.

Other options include a fold-down magazine rack situated below the head aperture, thus allowing the user to read while lying prone and maintaining optimum orthopedic positioning. One or more additional pull-out trays may be built into the frame for beverages, books and related personal possessions. Wheels can be incorporated into some or all of the legs to allow the user easy means to relocate the chair by simply lifting one end and wheeling the chair to a new location. Attachable cushions with a matching face opening can be strapped over the seat and back sections, and can be tied together or fastened with velcro or the like.

According to another aspect of the present invention, a lounge chair is disclosed. The lounge chair includes a frame, a seat section defining a substantially rigid orthopedic upper surface, a back section defining a substantially rigid upper surface and a hinge section disposed between the seat and back sections to facilitate pivotal movement between them. The seat and back sections are couple to the frame, while the back section includes an adjustable head aperture integrally formed therein.

Optionally, the substantially rigid upper surfaces of the seat and back sections are constructed predominantly of wood. As with the previous aspect, the hinge section comprises an actuator responsive to user input, a biasing member and an angle adjustment mechanism responsive to the actuator, where the angle adjustment mechanism is configured to allow a plurality of angular positions between the back section and the seat section. The biasing member promotes engagement of the angle adjustment mechanism and a corresponding member (such as the aforementioned catch) that is coupled to the back section, frame or both. In addition, the chair further comprises a plurality of longitudinally-spaced slats coupled to the back and seat sections to define the respective upper surfaces. As discussed previously, these slats are preferably made from a rigid material, such as wood. Furthermore, the head aperture is defined by cut-outs in at least a portion of the slats, and wherein at least the slats that define the head aperture are slidably coupled (either individually or together) to the back section to facilitate adjustability of the head aperture.

According to yet another aspect of the present invention, a method of using a lounge chair is disclosed. The method includes configuring the chair according to at least one of the previously described aspects. In addition, the method includes positioning a user on the chair such that at least one of the user's ventral or dorsal region is supported by the orthopedic upper surface such that the ventral or dorsal region substantially conforms with the orthopedic upper surface. In addition, the user adjusts the position of the head aperture within the back section, and then places a portion of his or her head in the head aperture. Optionally, the method includes configuring the hinge section in a manner similar to that previously described.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
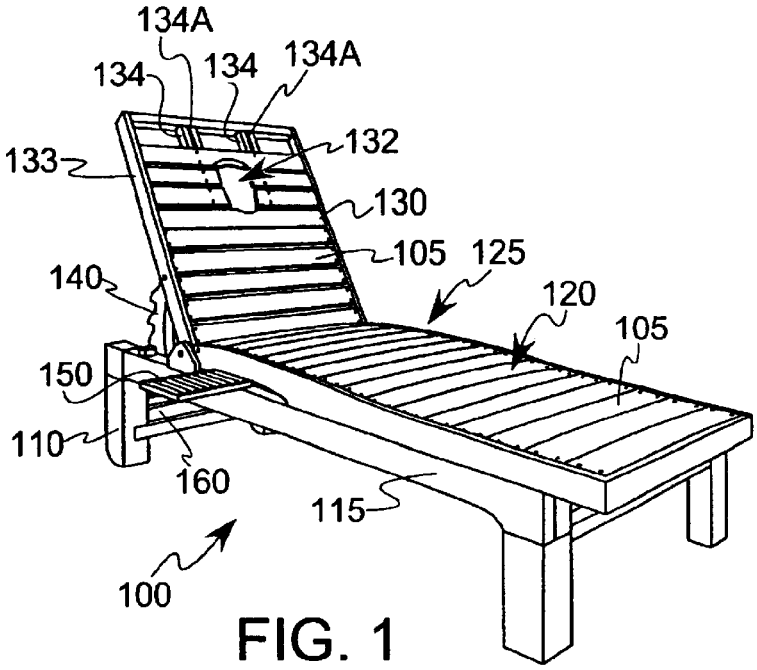
FIG. 1 illustrates a front perspective view of an embodiment of a lounge chair of the present invention in a first, seated position.
Figure 3:
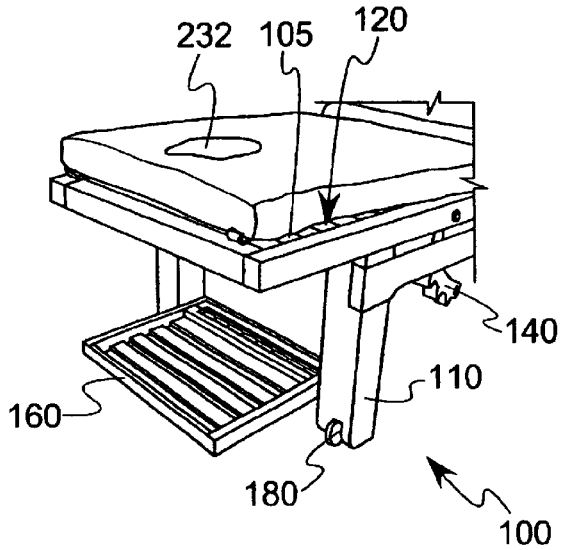
FIG. 3 illustrates a rear perspective view of a portion of the lounge chair in a second, recumbent position, and with an optional cushion placed on the chair's upper surface.
Figure 2A:
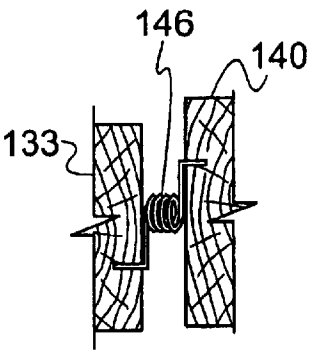
FIG. 2A illustrates a view of the spring-based bias between the back section and the angle adjustment mechanism of the lounge chair.
Figure 2:
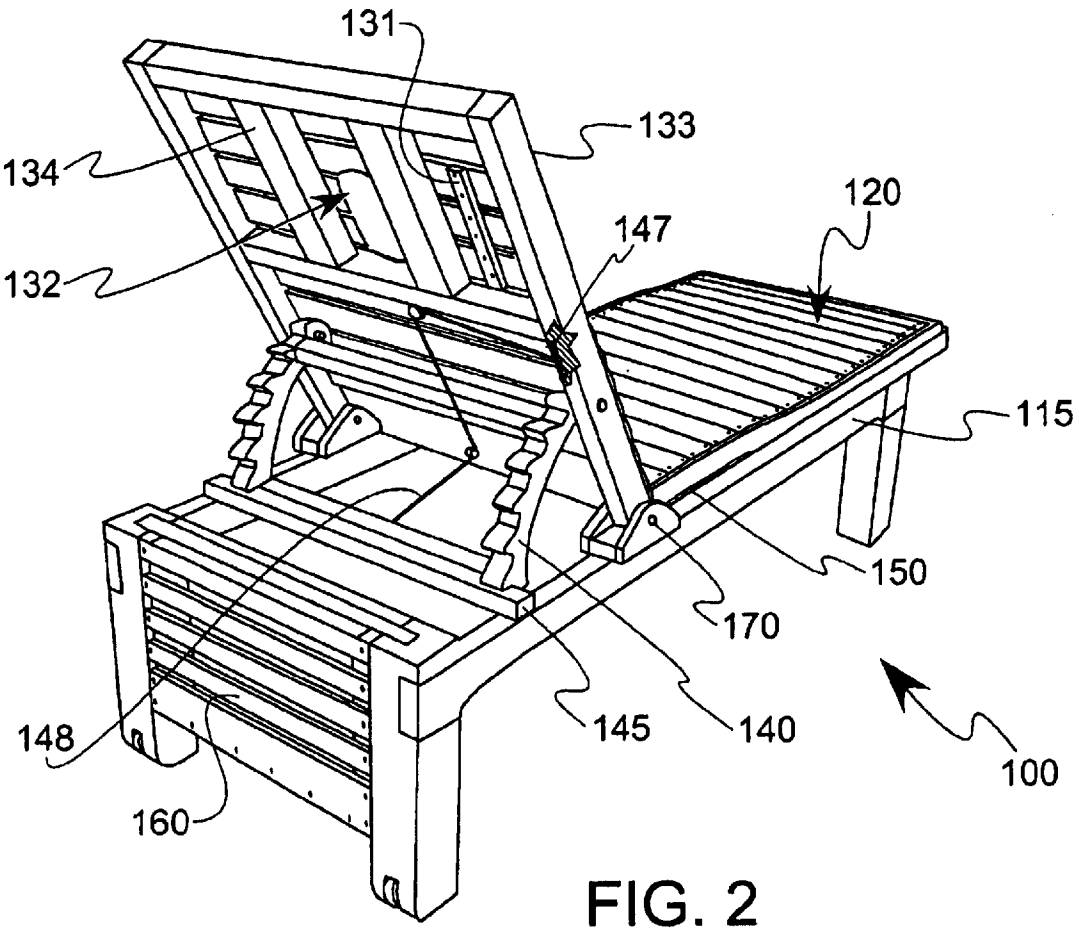
FIG. 2 illustrates a rear perspective view of the lounge chair of FIG. 1.

Referring first to FIGS. 1 through 3, a lounge chair 100 according to an aspect of the present invention is disclosed. It includes a frame 115 that supports a seat section 120 and back section 130. Frame 115 includes legs 110 and various interconnected support members, while both the seat and back sections 120, 130 include slats 105 with which to support the user. The lounge chair 100 of the present invention is preferably made of rigid, durable materials that require little or no maintenance. For example, frame 115, seat section 120 and back section 130 (as well as slats 105) are preferably made from hardwood, including, but not limited to ipe (also known as ironwood), oak, teak or the like. Seat section 120 includes an arched upper surface 125 that through such shape achieves improved orthopedic properties. While it will be appreciated by those skilled in the art that other orthopedic shapes are possible, the arched upper surface 125 is convex, such that it bows in an upward direction to engage a user's legs or back (when sitting or laying supine) or stomach and chest (when laying prone). For example, when a user is laying prone on chair 100, the arched upper surface 125 gently pushes upward on the hips of the user, straightening out the natural curvature of the lumbar section of the spine. This position relaxes the lumbar and avoids the uncomfortable hyperextension experienced by conventional lounge chairs. The arched upper surface 125 is rigidly formed into seat section 120 to ensure that its ergonomic features persist, even under the weight of a user.

Referring with particularity to FIGS. 2 and 2A, the back section 130 is coupled to the frame 115 through hinge section 170 so that the back section 130 may be placed in various angular positions relative to the frame 115 and seat section 120. As can be seen with particularity in FIG. 2, at least the lower portion of back section 130 is arched in a manner similar to that of seat section 120 to provide additional lower back support when a user is in a seated position. This is additionally beneficial when the lounge chair 100 is in its recumbent position and a user is lying prone on the lounge chair 100, as the arched portions of the seat and back sections 120, 130 together form a continuous curved upper surface. The back section 130 includes a head aperture (also referred to as a face cut-out) 132 that eliminates the need for the user to rotate the neck while lying prone, thus eliminating the undue stress to the upper neck and back, and allows the upper cervical spine to maintain alignment. Head aperture 132 includes beveled edges 132B to enhance comfort during prolonged periods of engagement with the user's head. The nature of the connection between slats 105 and back section 130 that gives rise to the adjustable dimensions of the head aperture 132 are shown, where the slats 105 that define the head aperture 132 are joined together by connector 131 so that the respective slats 105 (shown as a group of three, although greater or few may be used together) move in unison. In addition, the slats 105 joined by connector 131 can be slidably connected to back section 130 along longitudinal support members 134 that are in turn affixed to back section 130. This construction permits head aperture 132 to be slid up or down to allow users of different height to maintain optimum orthopedic positioning. Longitudinal support members 134 may include an elongate slot 134A (shown in FIG. 1) that along with a complementary projection from slats 105 can keep the aperture 132 properly aligned.

Figure 9:
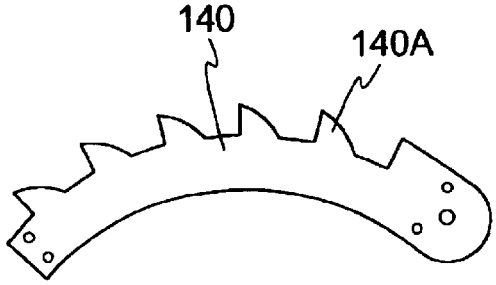
FIG. 9 illustrates the height adjustment device.

Referring with particularity to FIG. 9 in conjunction with FIGS. 2 and 2A, the back section 130, as previously mentioned, can be placed in various angular positions relative to the frame 115 and seat section 120 through hinge section 170, where an angle adjustment mechanism 140, catch 145, bias member (in the form of a coil spring 146 disposed about a bolt or related pivoting and securing member) and an actuator (in the form of release handle) 147 cooperate in conjunction with the pivot point of hinge section 170. Release handle 147 is placed on the lower (back) surface of back section 130, preferably adjacent a lateral edge 133 to allow the user to then lower the spring-loaded back section 130 with one hand while seated. The bias introduced by the spring 146 (which is temporarily overcome by application of force to the actuator 147) avoids the need for two-handed operation, where otherwise the user would require one hand to hold the back section portion in place while reach under the back section to adjust a catch-like mechanism. To lower the back section 130, the user simply squeezes the actuator 147 which pulls cable 148, thereby pivotally moving angle adjustment mechanism 140 so that splines 140A are disengaged from catch 145, thereby allowing the weight of the user to overcome the bias of spring 146 and cause back section 130 to lower to the desired position. By forcing a full, positive engagement of the catch 145 to angle adjustment mechanism 140, the risk of the catch 145 only partially engaging and collapsing onto the frame 115 is minimized. As shown with particularity in FIG. 2A, the spring 146 biases the angle adjustment mechanism 140 and the lateral edge 133 of back section 130 in such a way to promote safety by preventing a partially engaged catch 145 from slipping off and causing collapse of the back section 130. In addition, the positioning of actuator 147 adjacent the lateral edge 133 of back section 130 is such that by gripping the two simultaneously in order to make the adjustment, the user is further prevented from inadvertently collapsing the back section 130 down onto the frame 115 during the period where angle adjustment mechanism 140 is not engaged with catch 145. The tight tolerance between the frame 115 and the back section 130 leaves very little in the way of gaps, thereby minimizing the risk of pinching the user's hand when the back section 130 is fully reclined to a substantially flat position.

Figure 4:
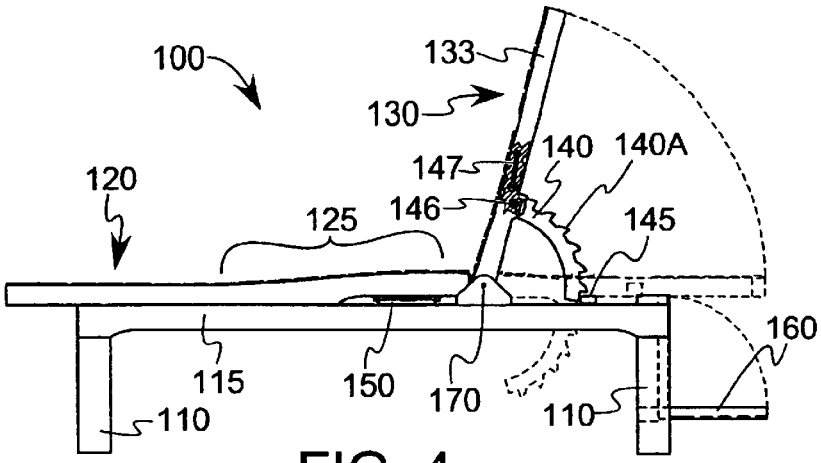
FIG. 4 illustrates a side elevation view of the lounge chair in its first, seated position.
Figure 5:
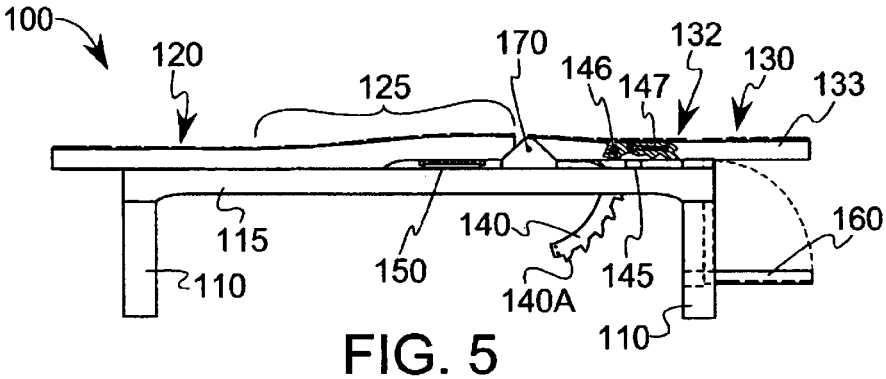
FIG. 5 illustrates a side elevation view of the lounge chair in its second, recumbent position.
Figure 6:
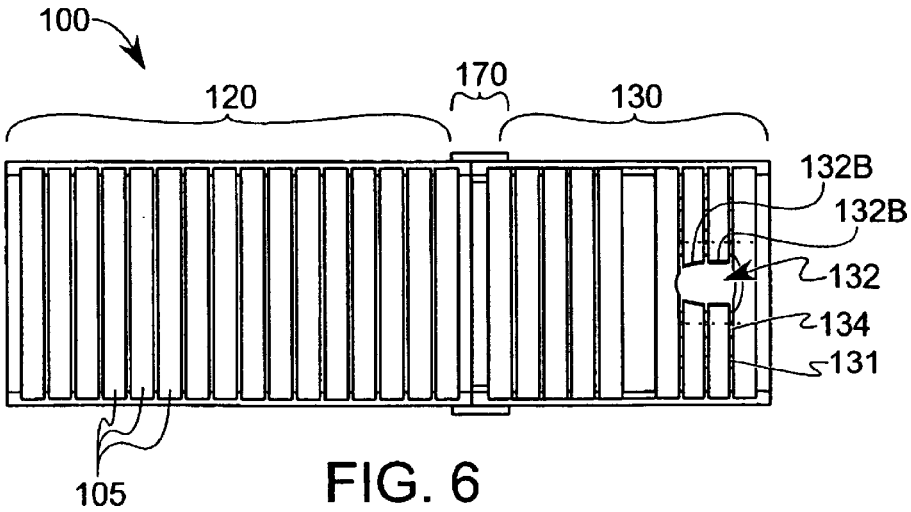
FIG. 6 illustrates a top view of the lounge chair.
Figure 7A:
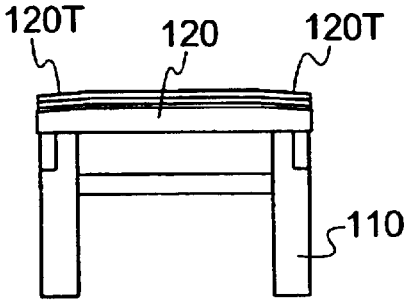
FIG. 7A illustrates a front end view of the lounge chair.
Figure 7B:
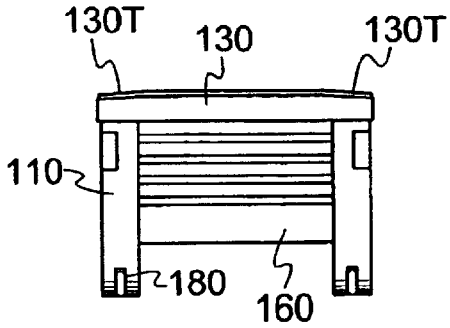
FIG. 7B illustrates a rear end view of the lounge chair.
Figure 8:
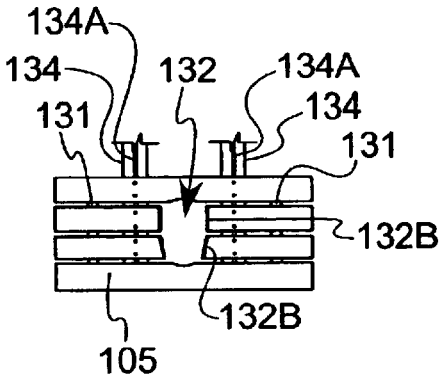
FIG. 8 illustrates a top view of the face cut-out portion of the back section of the lounge chair.
Figure 8A:
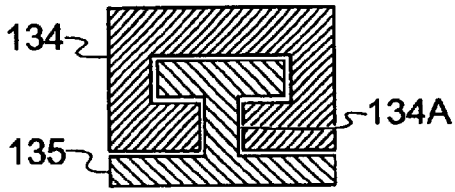
FIG. 8A illustrates a T-slot connection between one of the longitudinal support members and a slat mount.

Referring next to FIGS. 4 through 6 in conjunction with FIGS. 8 and 8A, the orthopedic upper surface 125 of seat section 120 and the complementary upper surface of the lower portion of back section 130 are shown in both a sitting position (FIG. 4) and recumbent position (FIGS. 5 through 7B). In particular, FIG. 4 shows how the spring 146 biases the splines 140A of the angle adjustment mechanism 140 to engage catch 145 to prevent the collapse of back section 130, while FIG. 5 shows how splines 140A of the angle adjustment mechanism 140 disengage catch 145 during periods where the back section 130 is lowered onto frame 115. FIG. 6 shows the placement of slats 105, and shows how slats 105 that define the head aperture 132 are supported by longitudinal support members 134 and are joined together by connectors 131 to allow longitudinal movement of the slats 105 in unison, while FIG. 8 shows this connection in more detail. In one preferred embodiment, the slats 105 that extend the substantial entirety of the wide of back section 130 are approximately 25 inches long, and between approximately 2.25 and 2.5 inches wide, with approximately 0.5 inch gaps between adjacent slats. FIG. 8A shows a sliding T-slot connection between one of the longitudinal support members 134 and a corresponding slat mount 135, where the latter may be secured to the slats 105 in a manner similar to that of connectors 131, using, for example, adhesives, screws or related fasteners. Referring again to FIG. 4, a laterally-disposed tray 150, in its stored position, is held in place between frame 115 and the space defined by the arched upper surface 125 of seat section 120. When use of tray 150 is desired, the user can grasp it along its outer edge and slide it out to its deployed position, as shown for example in FIG. 1. While the tray 150 is notionally shown deploying on the right side of chair 100, it will be appreciated by those skilled in the art that the tray could be deployed from the left side, or that two trays (one for each lateral side) could be included. Similarly, magazine rack 160, which can be used to support reading material (such as magazines, books or papers) is hingedly coupled to frame 115 so that upon placement of the back section 130 into a substantially horizontal orientation, a user may look through head aperture 132 and onto rack 160. The robustness inherent in the rigid construction of lounge chair 100 is such that its repositioning is made easier by the inclusion of wheels 180 placed at the lower end of one or more of legs 110. The wheels 180 can be placed in a substantially flush fit with legs 110; by not projecting significantly beyond the footprint of leg 110, wheels 180 are protected from inadvertent contact that could otherwise cause them damage or misalignment. In addition, the lower portion of legs 110 about wheels 180 can be faceted or tapered so that, even if the wheels 180 do not extend below a plane defined by the lower portion of leg 110, they do form a slight projection relative to the lower corner of the leg, so that upon tilting chair 100, the projecting portion of the wheels 180 engages the ground (or other surface upon which chair 100 was resting) to facilitate rolling or related chair repositioning.

Referring next to FIGS. 7A and 7B, seat section 120 can be downwardly tapered 120T along the lateral (sideways) dimensions such that the height of the upper surface is lower in the region over the legs 110 than it is in the center of seat section 120. By having a downward taper along the lateral periphery rather than the concavity experienced in the seat and back sections of conventional lounge chairs, the present invention promotes ease of chair ingress and egress. Similarly, by having the body-engaging upper surfaces of the seat and back sections 120, 130 be of substantially rigid construction, and not relying on straps or fabric that stretch downward under the applied weight of a user, ease of use is further enhanced. Magazine rack 160 is shown in its retracted position in FIG. 7B, while wheels 180 are shown embedded into the lower part of legs 110. Referring with particularity to FIG. 7A, back section 130 can be downwardly tapered 130T along the lateral dimensions in a manner similar to that of seat section 120.

Figure 10A:
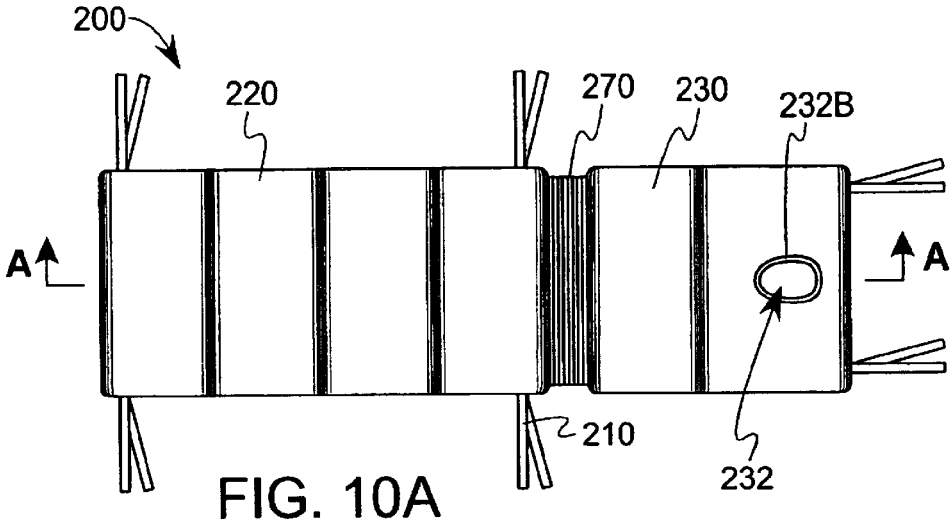
FIG. 10A illustrates a top view of a cushion configured to rest on the lounge chair of FIG. 1.
Figure 10B:
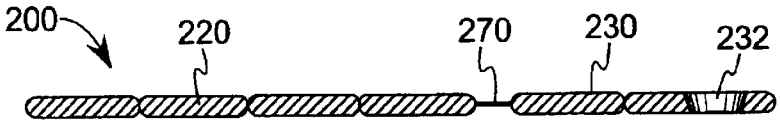
FIG. 10B illustrates a cutaway view of the cushion along lines A—A.

Referring with particularity to FIG. 3 in conjunction with FIGS. 10A and 10B, a cushion 200 (made from, for example, foam) can be attached to the seat and back sections 120, 130 to provide a soft surface upon which the user may rest. The outer corners of cushion 200 can be rounded. In one form, cushion 200 includes numerous segmented seat sections 220 that can flex relative to one another, thereby conforming more closely to the contours of the convex upper surface 125 of the seat section 120. Similarly, segmented back sections 230 can be placed over corresponding back section 130 of lounge chair 100. In another configuration (not shown), seat section 220 and back section 230 can each be of one non-segmented piece separated by a hinge section 270. In either configuration, head aperture 232 is formed into the back section 230 and can be aligned with the corresponding head aperture 132 in back section 130. In addition, head aperture 232 can be bevelled 232B along its periphery so provide a more gradual transition and additional user comfort. Ties 210 can be used to secure cushion 200 to chair 100, and can be made of any suitable securing member (including simple string or rope-like material, or velcro). Hinge 270 incorporated between seat section 220 and back section 230 allows for flexure of the underlying back section 130 of chair 100. In one form, hinge 270 can be approximately four inches wide and made of a thin connecting portion to minimize flexure-induced stress.

Figure 11A:
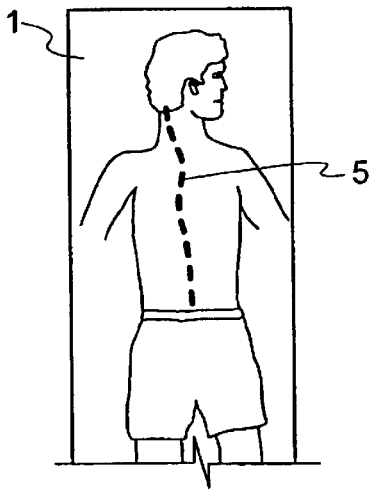
FIG. 11A (PRIOR ART)
FIG. 11A illustrates a person laying on a lounge chair according to the prior art.
Figure 11B:
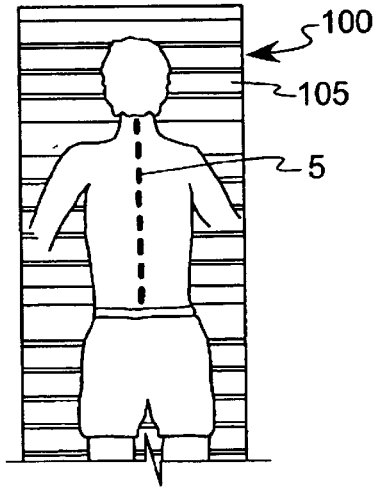
FIG. 11B illustrates a person laying on the lounge chair according to an embodiment of the present invention.

Referring next to FIGS. 11A and 11B, a comparison of a lounge chair 1 without a head aperture to the lounge chair 100 of the present invention reveals differing impacts on a user's spine 5. In the scenario depicted in FIG. 11A, the turning of the head produces contortions in spine 5, resulting in user discomfort over prolonged use periods. By contrast, with the chair 100 of the present invention, the head aperture 132 (not presently shown) allows user's head to be oriented straightforward, with a concomitant straightening of spine 5. Moreover, the adjustable nature of head aperture 132 (as previously discussed) is such that users of various heights may be comfortably accommodated.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A lounge chair comprising:

a frame;

a seat section coupled to said frame, said seat section defining a substantially rigid upper surface;

a back section cooperative with said frame, said back section defining a substantially rigid upper surface, said seat and back sections comprising a plurality of longitudinally-spaced slats coupled thereto to define said respective upper surfaces, said back section comprising an adjustable head aperture formed therein by cut-outs in at least a portion of said slats, and wherein at least said slats that define said head aperture are slidably coupled to said back section to facilitate adjustability of said head aperture; and a hinge section disposed between said seat and back sections to facilitate pivotal movement therebetween.

2. The lounge chair of claim 1, wherein said substantially rigid upper surfaces of said seat and back sections are constructed predominantly of wood.

3. The lounge chair of claim 2, wherein said wood comprises hardwood.

4. The lounge chair of claim 3, wherein said hardwood is selected from the group consisting of ipe, teak and oak.

5. The lounge chair of claim 1, wherein said hinge section comprises:

an actuator responsive to user input;

an angle adjustment mechanism responsive to said actuator, said angle adjustment mechanism configured to allow a plurality of angular positions between said back section and said seat section; and a biasing member configured to promote engagement of said angle adjustment mechanism and a corresponding member on at least one of said back section and said frame.

6. The lounge chair of claim 5, wherein said actuator is disposed on said back section and is responsive to single-hand input such that said angular position between said seat and back sections can be adjusted while said user is on said lounge chair.

7. The lounge chair of claim 5, wherein said biasing member comprises a spring.

8. The lounge chair of claim 1, wherein said substantially rigid upper surfaces of at least one of said seat and back sections define orthopedic curvature.

9. The lounge chair of claim 8, wherein said orthopedic curvature defines a curvature along a longitudinal dimension of said chair.

10. The lounge chair of claim 8, wherein said orthopedic curvature of said seat section upper surface is integrally formed therein.

11. The lounge chair of claim 8, wherein said orthopedic curvature of said seat section upper surface defines a substantially convex shape.

12. The lounge chair of claim 1, wherein said slidably coupled slats are adjustable along at least a longitudinal dimension of said lounge chair.

13. The lounge chair of claim 1, wherein said seat section defines a lateral taper on said upper surface.

14. The lounge chair of claim 1, further comprising a magazine rack coupled to said frame or said back section.

15. The lounge chair of claim 14, wherein said magazine rack is hingedly connected to said frame or back section such that upon deployment, said magazine rack is situated adjacent said head aperture.

16. The lounge chair of claim 1, further comprising a pull-out tray cooperative with said frame or said seat section.

17. The lounge chair of claim 1, further comprising wheels disposed in at least one leg of said frame.

18. The lounge chair of claim 1, further comprising at least one cushion configured to engage at least one of said seat section upper surface and said back section upper surface.

19. The lounge chair of claim 18, wherein said cushion defines an opening therethrough such that upon placement of said cushion onto said lounge chair, said head aperture and said opening are substantially aligned.

20. The lounge chair of claim 19, wherein said cushion further comprises an attachment member with which to engage said lounge chair.

21. The lounge chair of claim 20, wherein said attachment member comprises at least one strap.

22. The lounge chair of claim 21, wherein said at least one strap comprises a hook-and-loop fastener.

23. A method of using a lounge chair, said method comprising:

configuring said chair to comprise:

a frame;

a seat section coupled to said frame, said seat section defining a substantially rigid upper surface;

a back section cooperative with said frame, said back section defining a substantially rigid upper surface, said seat and back sections comprising a plurality of longitudinally-spaced slats coupled thereto to define said respective upper surfaces, said back section comprising an adjustable head aperture formed therein by cut-outs in at least a portion of said slats, and wherein at least said slats that define said head aperture are slidably coupled to said back section to facilitate adjustability of said head aperture; and a hinge section disposed between said seat and back sections to facilitate pivotal movement therebetween;

positioning a user on said chair such that at least one of said user's ventral and dorsal regions is placed on said upper surface; and placing a portion of said user's head in said head aperture.

24. The method of claim 23, further comprising adjusting the position of said head aperture within said back section.

25. The method according to claim 23, wherein said hinge section comprises:

an actuator responsive to user input;

an angle adjustment mechanism responsive to said actuator, said angle adjustment mechanism configured to allow a plurality of angular positions between said back section and said seat section; and a biasing member configured to promote engagement of said angle adjustment mechanism and a corresponding member on at least one of said back section and said frame.

26. The method of claim 23, wherein said configuring said chair further comprises configuring at least said back section and said seat section predominantly from wood.

* * * * *